US007102342B2

(12) United States Patent
Kim

(10) Patent No.: US 7,102,342 B2
(45) Date of Patent: Sep. 5, 2006

(54) CURRENT REFERENCE CIRCUIT WITH VOLTAGE-TO-CURRENT CONVERTER HAVING AUTO-TUNING FUNCTION

(75) Inventor: Jae-Wan Kim, Suwon-si (KR)

(73) Assignee: Samsung Electronics, Co., Ltd., (KR)

( * ) Notice: Subject to any disclaimer, the term of this patent is extended or adjusted under 35 U.S.C. 154(b) by 61 days.

(21) Appl. No.: 11/029,282

(22) Filed: Jan. 5, 2005

(65) Prior Publication Data

US 2005/0146316 A1 Jul. 7, 2005

(30) Foreign Application Priority Data

Jan. 7, 2004 (KR) ..... 10-2004-0000889

(51) Int. Cl.
*G05F 3/20* (2006.01)
*G05F 3/16* (2006.01)

(52) U.S. Cl. ..... 323/316; 323/313; 323/277

(58) Field of Classification Search ..... 323/313, 323/315, 316, 274, 277, 276
See application file for complete search history.

(56) References Cited

U.S. PATENT DOCUMENTS 4,931,718 A 6/1990 Zitta ..... 323/313
5,231,316 A 7/1993 Thelen, Jr. ..... 307/491
5,512,814 A * 4/1996 Allman ..... 323/267
5,552,697 A * 9/1996 Chan ..... 323/282
5,563,501 A * 10/1996 Chan ..... 323/282
5,757,175 A 5/1998 Morishita et al. ..... 323/315
5,912,583 A * 6/1999 Pierson et al. ..... 327/553
6,140,867 A 10/2000 de Micheli et al. ..... 327/553
6,388,507 B1 5/2002 Hwang et al. ..... 327/538
6,452,766 B1 * 9/2002 Carper ..... 361/18

FOREIGN PATENT DOCUMENTS

KR 93-20847 10/1993
KR 1999-0051452 7/1999

* cited by examiner

*Primary Examiner*—Bao Q. Vu
(74) *Attorney, Agent, or Firm*—Mills & Onello LLP

(57) ABSTRACT

A current reference circuit has a band gap voltage generating circuit, a voltage buffer, a voltage-to-current converting circuit and an auto-tuner. The band gap voltage generating circuit generates a band gap reference voltage. The voltage buffer generates a first bias voltage and a second bias voltage. The voltage-to-current converting circuit generates a source current in response to a tuning voltage. The auto-tuner generates the tuning voltage to maintain a transconductance. Thus, the current reference circuit may automatically adjust the transconductance, so that the current reference circuit may supply the source current that is stable against temperature and process variations.

22 Claims, 8 Drawing Sheets

CURRENT REFERENCE CIRCUIT WITH VOLTAGE-TO-CURRENT CONVERTER HAVING AUTO-TUNING FUNCTION

CROSS REFERENCE TO RELATED APPLICATION

This application relies for priority upon Korean Patent Application No. 2004-889 filed on Jan. 7, 2004, the contents of which are herein incorporated by reference in its entirety.

BACKGROUND OF THE INVENTION

1. Field of the Invention

The present invention relates to a current reference circuit. More particularly, the present invention relates to a current reference circuit having a voltage-to-current converting circuit with an auto-tuning function.

2. Description of the Related Art

A current reference circuit supplies a bias current to an operational amplifier, a filter, an analog-to-digital converter, a digital-to-analog converter, etc. In general, a current reference circuit includes a reference voltage generating circuit that generates a reference voltage and a voltage-to-current converter that converts the reference voltage into a current. In designing a semiconductor integrated circuit using a complementary metal oxide semiconductor (CMOS) process, the reference voltage is generated by a band gap circuit that is stable against temperature variation. The reference voltage generated by the band gap circuit is usually called a band gap reference voltage. One approach to the band gap reference voltage generating circuit has been disclosed in U.S. Pat. No. 4,931,718 by Heinz Zitta.

FIG. 1 is a circuit diagram showing a conventional voltage-to-current converting circuit. The conventional voltage-to-current converting circuit has been disclosed in U.S. Pat. No. 5,231,316.

Referring to FIG. 1, the voltage-to-current converting circuit includes an operational amplifier 2, an NMOS transistor 9 and a resistor R. A reference voltage VREF is applied to a line 1 connected to a positive input terminal of the operational amplifier 2. An output line 3 of the operational amplifier 2 is connected to a gate of the NMOS transistor 9. A negative input terminal of the operational amplifier 2 is connected through a feedback loop 6 to a source of the NMOS transistor 9. The source of the NMOS transistor 9 is also connected to one terminal of the resistor R, and the other terminal of the resistor R is connected to a ground GND. An output current IO is applied to a drain of the NMOS transistor 9 through a line 5. The voltage-to-current conversion may be achieved by maintaining the reference voltage VREF across the resistor R using the operational amplifier 2. By definition, the reference voltage VREF on the line 1, which is connected to the positive input terminal of the operational amplifier 2, also occurs at a node 8. The output current IO may be represented by an expression of VREF/R.

However, since a resistance value of the resistor R is easily affected by variations in manufacturing process and operational temperature, accuracy of the voltage-to-current converting circuit shown in FIG. 1 may be degraded. When the resistance value of the resistor R varies due to the variations in process and temperature, the output current IO also varies so that the semiconductor integrated circuit using the output current IO may malfunction.

Thus, there is a need for a voltage-to-current converting circuit and a current reference circuit capable of supplying stably a current independent of the variations in process and temperature.

BRIEF SUMMARY OF THE INVENTION

The present invention provides a current reference circuit that is stable independent of manufacturing process and operational temperature variations by controlling constantly a transconductance based on variations in process and temperature.

The present invention also provides a current reference circuit that is stable independent of process and temperature variations by controlling constantly a metal-oxide-semiconductor (MOS) resistance based on variations in process and temperature.

In some embodiments of the present invention, a current reference circuit includes: a band gap voltage generating circuit configured to generate a band gap reference voltage that is stable against a temperature variation; a voltage buffer configured to generate a first bias voltage and a second bias voltage in response to the band gap reference voltage, the first and second bias voltages being stable against the temperature variation; a voltage-to-current converting circuit configured to generate a source current that is stable against temperature and process variations using a transconductance circuit responding to a tuning voltage, in response to the first and second bias voltages; and an auto-tuner having a phase-locked loop circuit, the auto-tuner receiving an input clock signal and generating the tuning voltage to maintain a transconductance value of the transconductance circuit.

The voltage buffer may include an operational amplifier, a feedback resistor and a quantity n resistors, where n is a natural number. The operational amplifier includes a first input terminal receiving the band gap reference voltage, a second input terminal receiving a node voltage of a first node and an output terminal. The operational amplifier amplifies a difference between the band gap reference voltage and the node voltage of the first node.

The feedback resistor is coupled between the output terminal of the operational amplifier and the second input terminal of the operational amplifier.

The n resistors are coupled in series between the first node and a ground.

The first bias voltage is outputted from an i-th resistor (i is a natural number) among the n resistors numbered from the first node, and the second bias voltage is outputted from an (i−1)th resistor among the n resistors numbered from the first node.

In one embodiment, the n resistors have equal resistance values.

In one embodiment, the voltage-to-current converting circuit includes a common mode voltage generator, a differential voltage generator and a voltage-to-current converter.

The common mode voltage generator maintains a transconductance value in response to the tuning voltage to generate a common mode voltage. The differential voltage generator receives the first bias voltage, the second bias voltage and the common mode voltage to generate a pair of differential voltages. An average voltage level of the differential voltage pair is substantially equal to the common mode voltage. The voltage-to-current converter receives the differential voltage pair so as to generate the source current that is stable against temperature and process variations with the transconductance ($g_m$) circuit responding to the tuning voltage.

In one embodiment, the common mode voltage generator includes a first transconductance circuit having two output terminals electrically shorted to each other and two input terminals commonly coupled to the output terminals, the first transconductance circuit generating the common mode voltage.

In one embodiment, the differential voltage generator comprises: a first output terminal; a second output terminal; a first differential input part having a first input terminal connected to the second output terminal and a second input terminal to which the first bias voltage is applied; and a second differential input part having a first input terminal coupled to the first output terminal and a second input terminal to which the second bias voltage is applied.

In one embodiment, the voltage-to-current converter comprises: an operational amplifier configured to amplify a difference between a first output voltage of the differential voltage generator and the node voltage of the first node; a second transconductance circuit having a first input terminal, a second output terminal coupled to the first input terminal, a second input terminal commonly coupled to the first node with a first output terminal, the second transconductance circuit receiving a second output voltage from the differential voltage generator through the first input terminal to vary the transconductance value in response to the tuning voltage; a first NMOS transistor whose gate is coupled to the output of the operational amplifier to receive the amplified difference signal and whose source is coupled to the first node; and a current mirror circuit, coupled to a drain of the first NMOS transistor, configured to supply a first current to the first NMOS transistor, and configured to generate the source current corresponding to the first current.

In one embodiment, the current mirror circuit comprises: a second NMOS transistor having a gate, a drain coupled to a power voltage and a source coupled to the drain of the first NMOS transistor, the gate being coupled to the source; and a third NMOS transistor having a drain coupled to the power voltage, a gate coupled to the gate of the second NMOS transistor and a source from which the source current is outputted.

In one embodiment, the auto-tuner includes a phase-frequency detector, a charge pump, a loop filter and a voltage controlled oscillator (VCO).

The phase-frequency detector detects a phase difference and a frequency difference between the input clock signal and the feedback signal. The charge pump generates a signal in response to an output signal outputted from the phase-frequency detector. The loop filter receives the signal outputted from the charge pump and removes high frequency components of the signal outputted from the charge pump. The loop filter integrates the signal from which the high frequency components are removed so as to generate the tuning voltage. The voltage controlled oscillator generates the feedback signal having a frequency corresponding to a level of the tuning voltage.

As a result, the auto-tuner receives the input clock signal and generates the tuning voltage, thereby uniformly maintaining the transconductance value of the transconductance circuit.

In one embodiment, the auto-tuner further comprises a divider configured to divide the feedback signal outputted from the voltage controlled oscillator and configured to feed-back the divided feedback signal to the phase-frequency detector.

In one embodiment, the voltage controlled oscillator comprises: a first VCO transconductance circuit configured to have a first input terminal, a second input terminal, a first output terminal and a second output terminal, and configured to have a transconductance value that is maintained as substantially a constant value in response to the tuning voltage; a second VCO transconductance circuit configured to have a first input terminal coupled to the second output terminal of the first VCO transconductance circuit, a second input terminal coupled to the first output terminal of the first VCO transconductance circuit, a first output terminal coupled to the first input terminal of the first VCO transconductance circuit and a second output terminal connected to the second input terminal of the first VCO transconductance circuit, and configured to have a transconductance value uniformly maintained in response to the tuning voltage; a first capacitor coupled between the second output terminal of the first VCO transconductance circuit and the second input terminal of the second VCO transconductance circuit; a second capacitor coupled between the first input terminal of the first VCO transconductance circuit and the second output terminal of the second VCO transconductance circuit; a first resistor coupled between the first input terminal of the first VCO transconductance circuit and the second output terminal of the second VCO transconductance circuit; and a second resistor coupled between the first input terminal of the first VCO transconductance circuit and the second output terminal of the second VCO transconductance circuit, the second resistor having an opposite polarity to the first resistor.

In one embodiment, the voltage-to-current converting circuit comprises: an operational amplifier configured to amplify a difference between the second bias voltage and a node voltage of a first node to output a difference signal; a transconductance circuit having a first input terminal, a second output terminal coupled to the first input terminal, a second input terminal commonly coupled to the first node with a first output terminal, the transconductance circuit receiving the first bias voltage through the first input terminal to vary the transconductance value in response to the tuning voltage; a first NMOS transistor having a gate receiving the difference signal from the operational amplifier and a source coupled to the first node; and a current mirror circuit coupled to a drain of the first NMOS transistor, configured to supply a first current to the first NMOS transistor and configured to generate the source current corresponding to the first current.

In one embodiment, the current mirror circuit comprises: a second NMOS transistor having a gate, a drain coupled to a power voltage and a source coupled to the drain of the first NMOS transistor, the gate being coupled to the source; and a third NMOS transistor having a drain coupled to the power voltage, a gate coupled to the gate of the second NMOS transistor and a source from which the source current is outputted.

In accordance with another aspect of the present invention, a current reference circuit includes: a band gap voltage generating circuit configured to generate a band gap reference voltage that is stable against a temperature variation; a voltage buffer configured to generate a bias voltage that is stable against the temperature variation in response to the band gap reference voltage; a voltage-to-current converting circuit configured to generate a source current in response to the bias voltage, the source current being stable against temperature and process variations in response to a tuning voltage; and an auto-tuner configured to generate a tuning voltage in response to an input clock signal to maintain a transconductance ($g_m$) value of a transconductance circuit.

In one embodiment, the voltage-to-current converting circuit comprises: an operational amplifier configured to amplify a difference between the bias voltage and a node voltage of a first node to output the amplified signal; a first NMOS transistor having a gate coupled to an output of the operational amplifier to receive the amplified signal and a source coupled to the first node; a current mirror circuit coupled to a drain of the first NMOS transistor, configured to apply a first current to the first NMOS transistor, and configured to generate the source current corresponding to the first current; a transconductance circuit configured to have two output terminals electrically shorted to each other and two input terminals commonly coupled to the two output terminals, and configured to generate a common mode voltage; and a second NMOS transistor having a gate receiving the common mode voltage, a drain coupled to the first node and a source coupled to ground.

In one embodiment, the current mirror circuit comprises: a third NMOS transistor having a gate, a drain coupled to a power voltage and a source coupled to the drain of the first NMOS transistor, the gate being coupled to the source; and a fourth NMOS transistor having a drain coupled to the power voltage, a gate coupled to the gate of the third NMOS transistor and a source from which the source current is outputted.

In accordance with another aspect of the present invention, a voltage-to-current converting circuit includes: a common mode voltage generator configured to maintain a transconductance value in response to a tuning voltage to generate a common mode voltage; a differential voltage generator configured to generate a pair of differential voltages in response to a first bias voltage, a second bias voltage greater than the first bias voltage and the common mode voltage, an average voltage level of the differential voltage pair being substantially equal to the common mode voltage; and a voltage-to-current converter configured to generate a source current in response to the differential voltage pair, the source current being stable against temperature and process variations in response to the tuning voltage.

In one embodiment, the common mode voltage converter comprises a first transconductance circuit having two output terminals electrically shorted to each other and two input terminals commonly coupled to the two output terminals, the first transconductance circuit generating the common mode voltage. The differential voltage generator can include: a first output terminal; a second output terminal; a first differential input part having a first input terminal coupled to the second output terminal and a second input terminal receiving the first bias voltage; and a second differential input part having a first input terminal coupled to the first output terminal and a second input terminal receiving the second bias voltage.

In one embodiment, the voltage-to-current converter comprises: an operational amplifier configured to amplify a difference between a first output voltage of the differential voltage generator and a node voltage of a first node to generate the amplified signal; a second transconductance circuit having a first input terminal, a second output terminal coupled to the first input terminal, a second input terminal and a first output terminal commonly coupled to the first node with the second input terminal, the second transconductance circuit receiving a second output voltage from the differential voltage generator through the first input terminal and varying a transconductance value in response to the tuning voltage; a first NMOS transistor having a gate coupled to an output of the operational amplifier to receive the amplified signal and a source coupled to the first node; and a current mirror circuit, coupled to a drain of the first NMOS transistor, configured to apply a first current to the first NMOS transistor, and configured to generate the source current in response to the first current.

In one embodiment, the current mirror circuit comprises: a second NMOS transistor having a gate, a drain coupled to a power voltage and a source coupled to the drain of the first NMOS transistor, the gate being coupled to the source; and a third NMOS transistor having a drain coupled to the power voltage, a gate coupled to the gate of the second NMOS transistor and a source from which the source current is outputted.

BRIEF DESCRIPTION OF THE DRAWINGS

The foregoing and other objects, features and advantages of the invention will be apparent from the more particular description of preferred aspects of the invention, as illustrated in the accompanying drawings in which like reference characters refer to the same parts throughout the different views. The drawings are not necessarily to scale, emphasis instead being placed upon illustrating the principles of the invention. In the drawings, the thicknesses of layers are exaggerated for clarity.

DESCRIPTION OF THE EXMPLELARY EMBODIMENTS

Hereinafter, the present invention will be described in detail with reference to the accompanying drawings.

Figure 1:
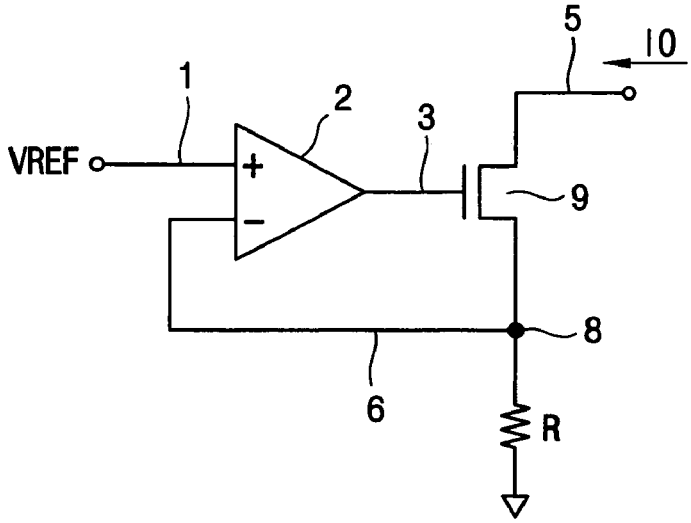
FIG. 1 is a circuit diagram showing a conventional voltage-to-current converting circuit.
Figure 2:
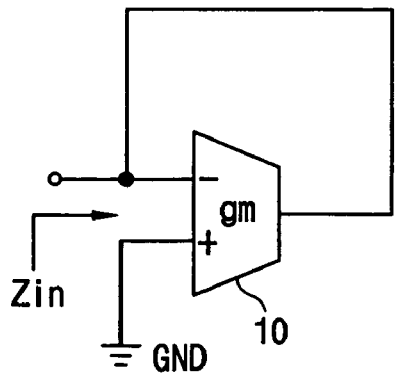
FIG. 2 is a circuit diagram showing an equivalent resistance of a transconductance circuit.

FIG. 2 is a circuit diagram showing an equivalent resistance of a transconductance circuit.

Referring to FIG. 2, a transconductance circuit 10 has an output terminal tied back to an inverting input terminal and a noninverting input terminal connected to a ground GND. In the transconductance circuit 10 shown in FIG. 2, an input impedance (Zin) is $1/g_m$ that is an equivalent resistance of the transconductance circuit 10.

Figure 3:
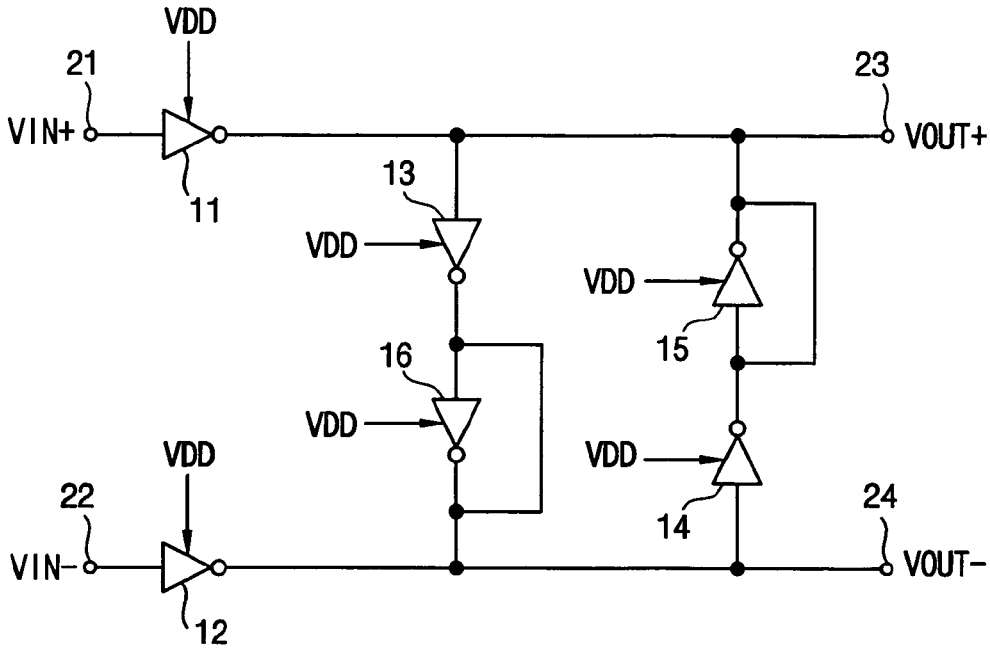
FIG. 3 is a circuit diagram showing a conventional transconductance circuit.

FIG. 3 is a circuit diagram showing a conventional transconductance circuit. The transconductance ($g_m$) circuit of FIG. 3 has been disclosed in U.S. Pat. No. 6,191,655. The transconductance circuit of FIG. 3 is called 'Nauta's $g_m$ circuit'. In FIG. 3, the transconductance circuit includes first, second, third, fourth, fifth and sixth inverters 11, 12, 13, 14, 15 and 16. The first and second inverters 11 and 12 generate a transconductance gain $g_m$ and the third, fourth, fifth and sixth inverters 13, 14, 15 and 16 fix the common mode voltage at output terminals 23 and 24.

In FIG. 3, differential inputs VIN+ and VIN− of the transconductance circuit are provided to input terminals 21 and 22 of the first and second inverters 11 and 12, respectively, and differential outputs VOUT+ and VOUT− from the transconductance circuit are provided at output terminals 23 and 24 of the first and second inverters 11 and 12, respectively. A common mode feedback loop is coupled across the output terminals 23 and 24. The common mode feedback loop includes the third and sixth inverters 13 and 16 coupled in series to each other. And, an output terminal of the sixth inverter 16 is tied back to an input terminal of the sixth inverter 16. Also, an input terminal of the third inverter 13 is coupled to the output terminal of the first inverter 11, and the output terminal of the sixth inverter 16 is coupled to the output terminal of the second inverter 12.

The common mode feedback loop also includes the fourth and fifth inverters 14 and 15 coupled in series to each other. An output terminal of the fifth inverter 15 is tied back to an input terminal of the fifth inverter 15. Also, an input terminal of the fourth inverter 14 is coupled to the output terminal 24 of the second inverter 12, and the output terminal of the fifth inverter 15 is coupled to the output terminal 23 of the first inverter 11. Each of the first, second, third, fourth, fifth and sixth inverters 11, 12, 13, 14, 15 and 16 includes a pull-up transistor (not shown) having a p-type metal-oxide-semiconductor (PMOS) and a pull-down transistor (not shown) having an n-type metal-oxide-semiconductor (NMOS). An inverter configured to have the PMOS and NMOS transistors has a transconductance ($g_m$) value given by the following equation 1.

$$gm=gmp+gmn=\beta p(Vdd-Vc-|Vtp|)+\beta n(Vc-Vtn) \quad \text{(Equation 1)}$$

where Vdd, Vc, βp and βn indicate a power supply voltage, a common mode voltage, a gain parameter of the PMOS transistor and a gain parameter of the NMOS transistor, respectively; Vtp and Vtn represent a threshold voltage of the PMOS transistor and a threshold voltage of the NMOS transistor, respectively; and gmp and gmn indicate the transconductance $g_m$ of the PMOS transistor and the transconductance $g_m$ of the NMOS transistor, respectively.

Referring to equation 1, the transconductance $g_m$ may be adjusted in accordance with a variation of the power voltage Vdd. That is, when the power supply voltage Vdd applied to each of the first to sixth inverters 11, 12, 13, 14, 15 and 16 is varied, the transconductance $g_m$ of the transconductance circuit may be adjusted.

Figure 4:
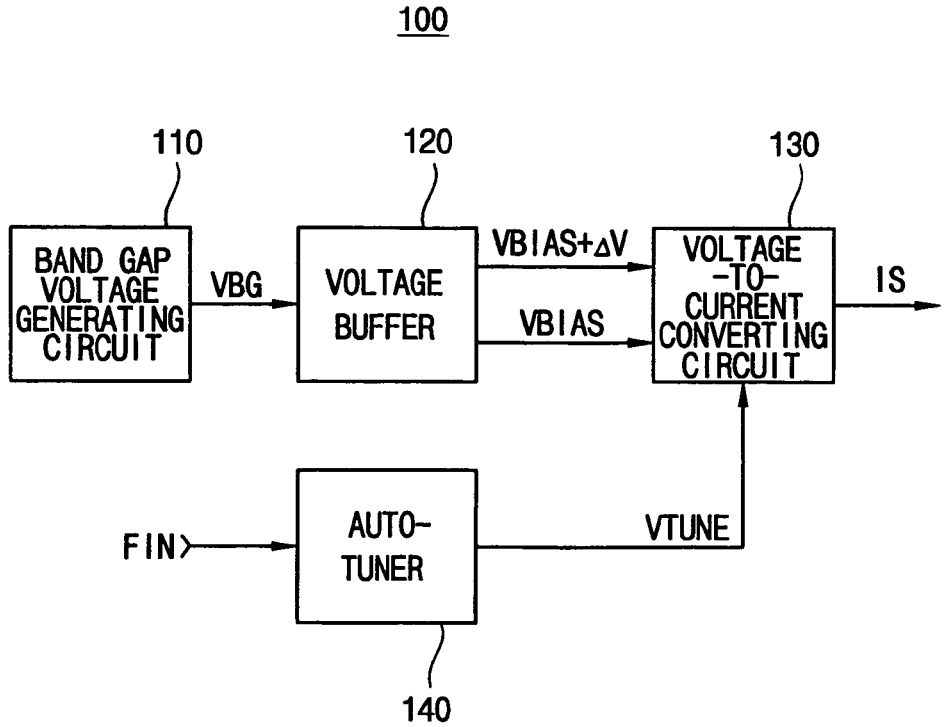
FIG. 4 is a block diagram showing a current reference circuit according to an exemplary embodiment of the present invention.

FIG. 4 is a block diagram showing a current reference circuit according to an exemplary embodiment of the present invention.

Referring to FIG. 4, a current reference circuit 100 includes a band gap voltage generating circuit 110, a voltage buffer 120, a voltage-to-current converting circuit 130 and an auto-tuner 140.

Hereinafter, operation of the current reference circuit 100 shown in FIG. 4 will be described.

The band gap voltage generating circuit 110 generates a band gap reference voltage VBG that is stable against temperature variation. The band gap reference voltage VBG is applied to the voltage buffer 120 so that the voltage buffer 120 may generate a first bias voltage VBIAS and a second bias voltage VBIAS+ΔV. The first and second bias voltages VBIAS and VBIAS+ΔV are applied to the voltage-to-current converting circuit 130, so that the voltage-to-current converting circuit 130 may vary the transconductance $g_m$ of the transconductance circuit in response to a tuning voltage signal VTUNE to generate a source current IS that is stable against temperature and process variations. The auto-tuner 140 includes a phase-locked loop. The auto-tuner 140 receives an input clock signal FIN to generate the tuning voltage signal VTUNE, which causes the transconductance $g_m$ to be uniformly maintained.

Figure 5:
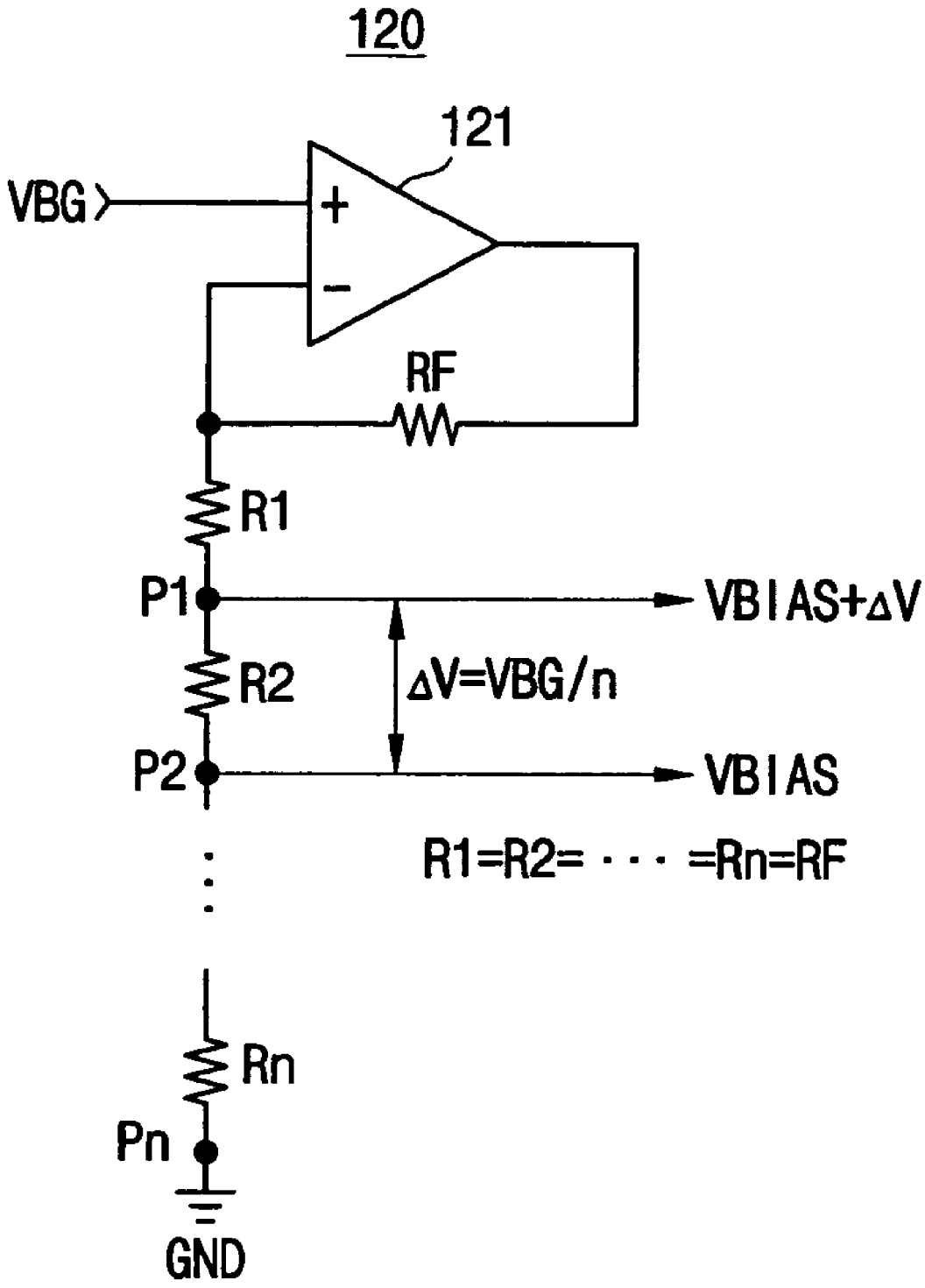
FIG. 5 is a circuit diagram showing a voltage buffer shown in FIG. 4.

FIG. 5 is a circuit diagram showing the voltage buffer shown in FIG. 4.

Referring to FIG. 5, the voltage buffer 120 includes an operational amplifier 121, a feedback resistor RF coupled between an output terminal and an inverting input terminal of the operational amplifier 121 and resistors R1 to Rn connected in series between the inverting input terminal of the operational amplifier 121 and a ground GND.

The band gap reference voltage VBG is applied to a noninverting input terminal of the operational amplifier 121, and then a voltage of the inverting input terminal of the operational amplifier 121 also has same value as the band gap reference voltage VBG by the characteristics of the operational amplifier. In order to stably operate the operational amplifier 121 against temperature variation, all of the resistors R1 to Rn and the feedback resistor RF have an identical resistance to each other. In FIG. 5, when R1=R2=. . . =Rn=RF and a voltage at a point of P2 is called VBIAS, VBIAS is VBG×(n−2)/n and ΔV is VBG/n.

Figure 6:
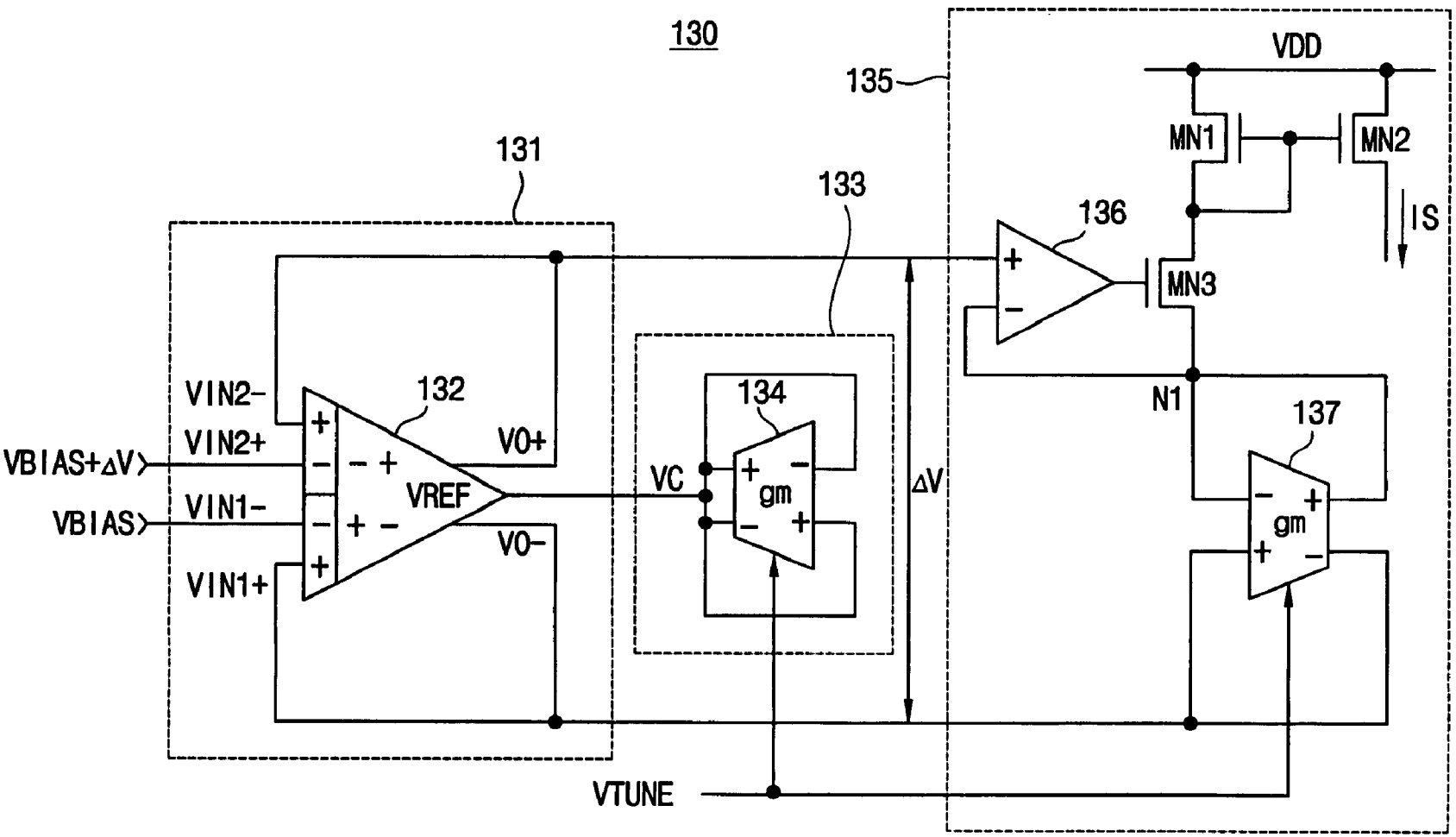
FIG. 6 is a circuit diagram showing an exemplary voltage-to-current converting circuit shown in FIG. 4.

FIG. 6 is a circuit diagram showing an exemplary voltage-to-current converting circuit shown in FIG. 4.

Referring to FIG. 6, the voltage-to-current converting circuit 130 includes a common mode voltage generator 133, a differential voltage generator 131 and a voltage-to-current converter 135.

The common mode voltage generator 133 generates a common mode voltage VC in response to the tuning voltage VTUNE.

The first bias voltage VBIAS, the second bias voltage VBIAS+ΔV and the common mode voltage VC are applied to the differential voltage generator 131 so that the differential voltage generator 131 may generate a balanced differential voltage pair having a first differential voltage V0+ and a second differential voltage V0−. An average voltage level of the first and second differential voltages V0+ and V0− is substantially equal to the common mode voltage VC. The first differential voltage V0+ is represented by an equation of V0+=VC+ΔV/2, and the second differential voltage V0− is represented by an equation of V0−=VC−ΔV/2.

The first and second differential voltages V0+ and V0− are applied to the voltage-to-current converter 135, so that the voltage-to-current converter 135 may vary the transconductance $g_m$ in response to the tuning voltage VTUNE to generate the source current that is stable against the temperature and process variations.

In addition, the common mode voltage generator 133 includes a transconductance circuit 134 whose two output terminals are short-circuited to each other and two input terminals are short-circuited to the output terminals. The two output terminals include a pair of differential outputs VOUT+ and VOUT− as in the transconductance circuit of FIG. 3. A voltage at the short-circuited output terminal is the common mode voltage VC.

The differential voltage generator 131 has a fully differential difference amplifier 132. The fully differential difference amplifier 132 includes a first differential input stage having a first input terminal VIN1+ is tied to a first output terminal V0− of the fully differential difference amplifier 132 and a second input terminal VIN1− to which the first bias voltage VBIAS is applied. The fully differential difference amplifier 132 also includes a second differential input stage having a third input terminal VIN2− is tied to a second output terminal V0+ of the fully differential difference amplifier 132 and a fourth input terminal VIN2+ to which the second bias voltage VBIAS+ΔV is applied.

The voltage-to-current converter 135 includes an operational amplifier 136, a transconductance ($g_m$) circuit 137, a first NMOS transistor MN1, a second NMOS transistor MN2 and a third NMOS transistor MN3.

The operational amplifier 136 amplifies a difference voltage between the first output voltage V0+ of the differential voltage generator 131 and a node voltage of the first voltage N1. The transconductance circuit 137 has a first input terminal tied to a second output terminal of the transconductance circuit 137 and a second input terminal tied to the first node N1 together with a first output terminal of the transconductance circuit 137. The transconductance circuit 137 varies the transconductance $g_m$ in response to the tuning voltage VTUNE. The third NMOS transistor MN3 has a gate receiving an output signal from the operational amplifier 136 and a source coupled to the first node N1. The first NMOS transistor MN1 has a gate, a drain coupled to the power voltage VDD and a source coupled to a drain of the third NMOS transistor MN3. The gate and source of the first NMOS transistor MN1 are coupled to each other. The second NMOS transistor MN2 has a drain coupled to the power voltage VDD and a gate coupled to the gate of the first NMOS transistor MN1. The source current IS is outputted from the source of the second NMOS transistor MN2.

Hereinafter, operation of the voltage-to-current converting circuit shown in FIG. 6 will be described.

The first and second bias voltages VBIAS and VBIAS+ΔV from the voltage buffer 120 are applied to the differential voltage generator 131 so that the differential voltage generator 131 may generate the first and second differential voltages V0+ and V0−. The first differential voltage V0+ having a value of VC+ΔV/2 is applied to the noninverting input terminal of the operational amplifier 136. The second differential voltage V0− having a value of VC−ΔV/2 is applied to the first input terminal of the transconductance circuit 137. As a result, the voltage at the first node N1 also has the value of voltage VC+ΔV/2 by the characteristics of the operational amplifier 136, and the voltage VC+ΔV/2 is applied to the second input terminal of the transconductance circuit 137. Thus, the difference voltage ΔV is applied between the first and second input terminals of the transconductance circuit 137.

The transconductance $g_m$ values of the transconductance circuits 134 and 137 of the common mode voltage generator 133 and the voltage-to-current converter 135, respectively, may be uniformly maintained in response to the tuning voltage VTUNE. Thus, although the temperature and process variations are varied, the transconductance $g_m$ values of the transconductance circuits 134 and 137 of the common mode voltage generator 133 and the voltage-to-current converter 135 may be uniformly maintained. When a voltage applied between the first and second input terminals of the transconductance circuit 137 and the transconductance $g_m$ are uniformly maintained, the source current IS may be uniformly maintained even though the temperature and process conditions are varied.

Figure 7:
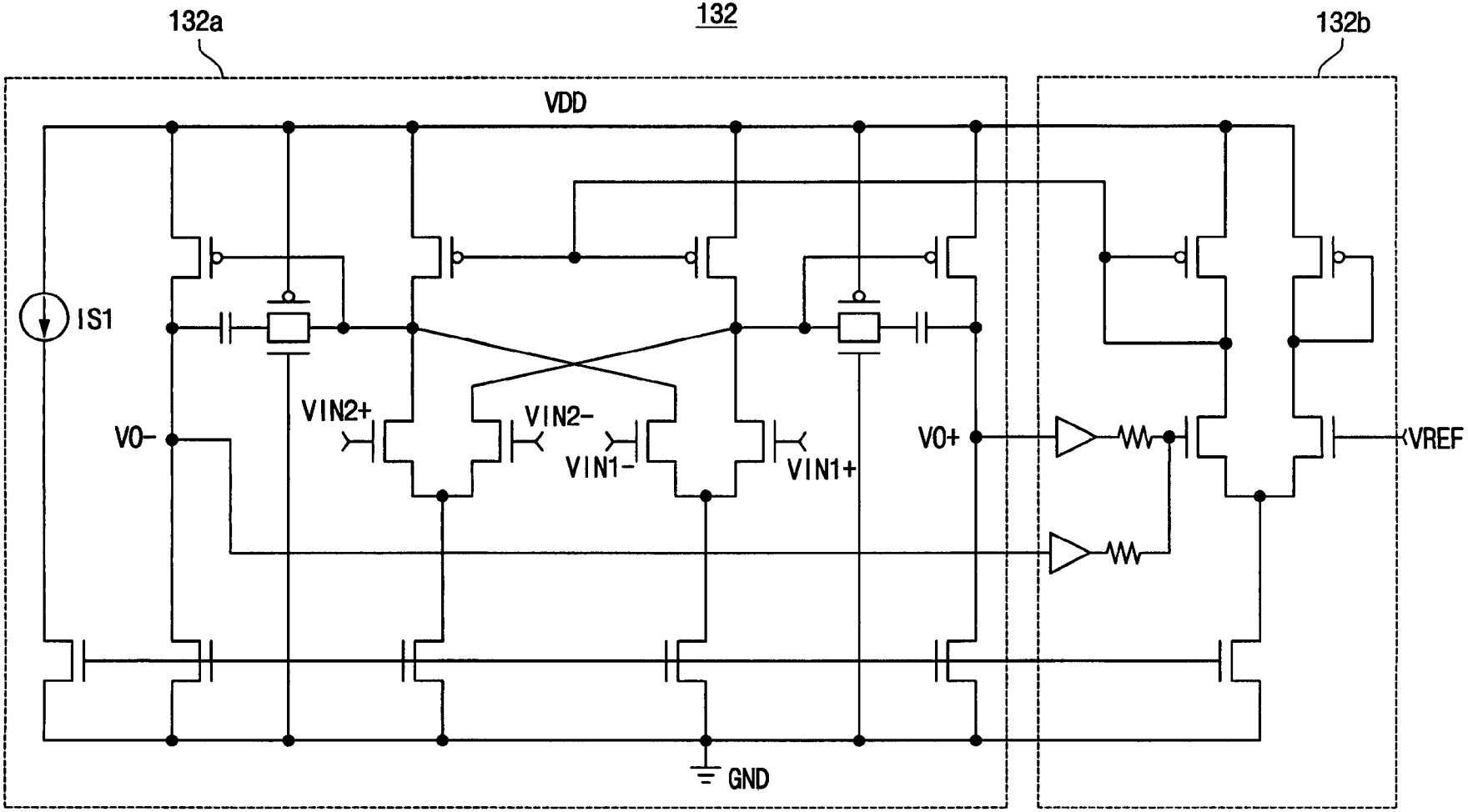
FIG. 7 is a circuit diagram showing a fully differential amplifier of the voltage-to-current converting circuit of FIG. 6.

FIG. 7 is a circuit diagram showing the fully differential difference amplifier of the voltage-to-current converting circuit of FIG. 6. The fully differential difference amplifier of FIG. 7 has been disclosed in "Fully Differential Basic Building Blocks Based on Fully Differential Difference Amplifiers with Unity-gain Difference Feedback" published in IEEE Transaction on Circuits and Systems I, Vol. 42, No. 3, March 1995 by J. F. Duque-Carrillo. The fully differential difference amplifier includes a differential amplifying circuit 132*a* and a common mode feedback circuit 132*b*.

Figure 8:
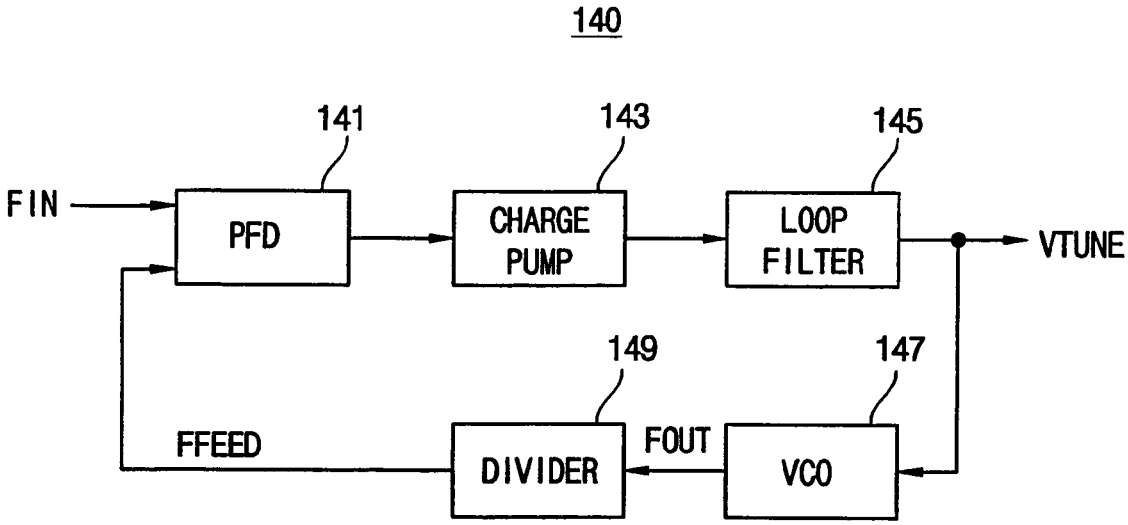
FIG. 8 is a block diagram showing an auto-tuner of the current reference circuit shown in FIG. 4.

FIG. 8 is a block diagram showing the auto-tuner of the current reference circuit shown in FIG. 4. The auto-tuner 140 includes the phase-locked loop having the transconductance circuit. The auto-tuner 140 receives the input clock signal FIN and generates the tuning voltage VTUNE.

Referring to FIG. 8, the auto-tuner 140 includes a phase-frequency detector (PFD) 141, a charge pump 143, a loop filter 145, a voltage controlled oscillator (VCO) 147 and a divider 149.

The PFD 141 detects a phase difference and a frequency difference between the input clock signal FIN and the feedback signal FFEED to output the detected phase difference and the detected frequency difference. The charge pump 143 outputs a signal having a different level from an output signal from the PFD 141 in accordance with a state of the output signal from the PFD 141. The loop filter 145 receives the output signal from the charge pump 143 to generate the tuning voltage VTUNE from which a high frequency component is removed. The VCO 147 generates a signal FOUT having a frequency corresponding to a level of the tuning voltage VTUNE. The divider 149 receives the output signal FOUT from the VCO to divide the received output signal FOUT.

Figure 9:
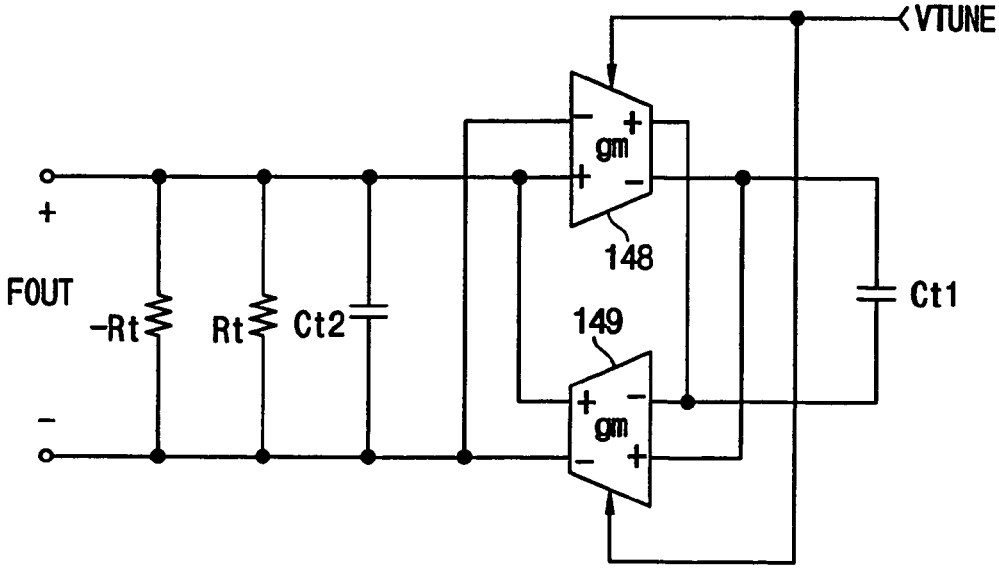
FIG. 9 is a circuit diagram showing a VCO of the auto-tuner shown in FIG. 8.

FIG. 9 is a circuit diagram showing the VCO of the auto-tuner shown in FIG. 8.

Referring to FIG. 9, the VCO 147 includes a first transconductance ($g_m$) circuit 148, a second transconductance ($g_m$) circuit 149, a first capacitor Ct1, a second capacitor Ct2, a first resistor Rt and a second resistor −Rt. The first capacitor Ct1 is coupled between an inverting output terminal of the first transconductance circuit 148 and an inverting input terminal of the second transconductance circuit 149. A noninverting output terminal of the first transconductance circuit 148 is coupled to the inverting input terminal of the second transconductance circuit 149, and a noninverting input terminal of the second transconductance circuit 149 is coupled to an inverting output terminal of the first transconductance circuit 148. The second capacitor Ct2, the first resistor Rt and the second resistor −Rt are connected in parallel between the noninverting input terminal of the first transconductance circuit 148 and the inverting output terminal of the second transconductance circuit 149. The noninverting input terminal of the first transconductance circuit 148 is coupled to the noninverting output terminal of the second transconductance circuit 149, and the inverting output terminal of the second transconductance circuit 149 is coupled to the inverting input terminal of the first transconductance circuit 148. A voltage between the noninverting input terminal of the first transconductance circuit 148 and the inverting output terminal of the second transconductance circuit 149 is the output voltage FOUT.

The first and second transconductance circuits 148 and 149 vary the transconductance $g_m$ in response to the tuning voltage VTUNE. The auto-tuner of FIG. 9 oscillates because the first and second transconductance circuits 148 and 149 and the first capacitor Ct1 are operated as an inductor. The first and second resistors Rt and −Rt are coupled in parallel between the noninverting input terminal of the first transconductance circuit 148 and the inverting output terminal of the second transconductance circuit 149 to stably oscillate the VCO 147 without attenuation of oscillation amplitude of the VCO 147.

Hereinafter, operation of the auto-tuner 140 will be described in detail with reference to FIGS. 8 and 9.

When the transconductance $g_m$ is reduced due to temperature and process variations, frequencies of the output voltage FOUT from the VCO 147 and the feedback signal FFEED are reduced. Then, the output signal from the PFD 141 becomes in a high state, and the output signal from the charge pump 143 increases. Thus, the tuning voltage VTUNE from the loop filter 145 increases, and the transconductance $g_m$ values of the first and second transconductance circuits 148 and 149 increase.

On the other hand, when the transconductance $g_m$ increases due to temperature and process variations, frequencies of the output voltage FOUT from the VCO 147 and the feedback signal FFEED increase. Then, the output signal from the PFD 141 becomes in a low state, and the output signal from the charge pump 143 decreases. Thus, the tuning voltage VTUNE from the loop filter 145 decreases, and the transconductance $g_m$ values of the first and second transconductance circuits 148 and 149 decrease. As a result, the transconductance $g_m$ may be uniformly maintained.

Figure 10:
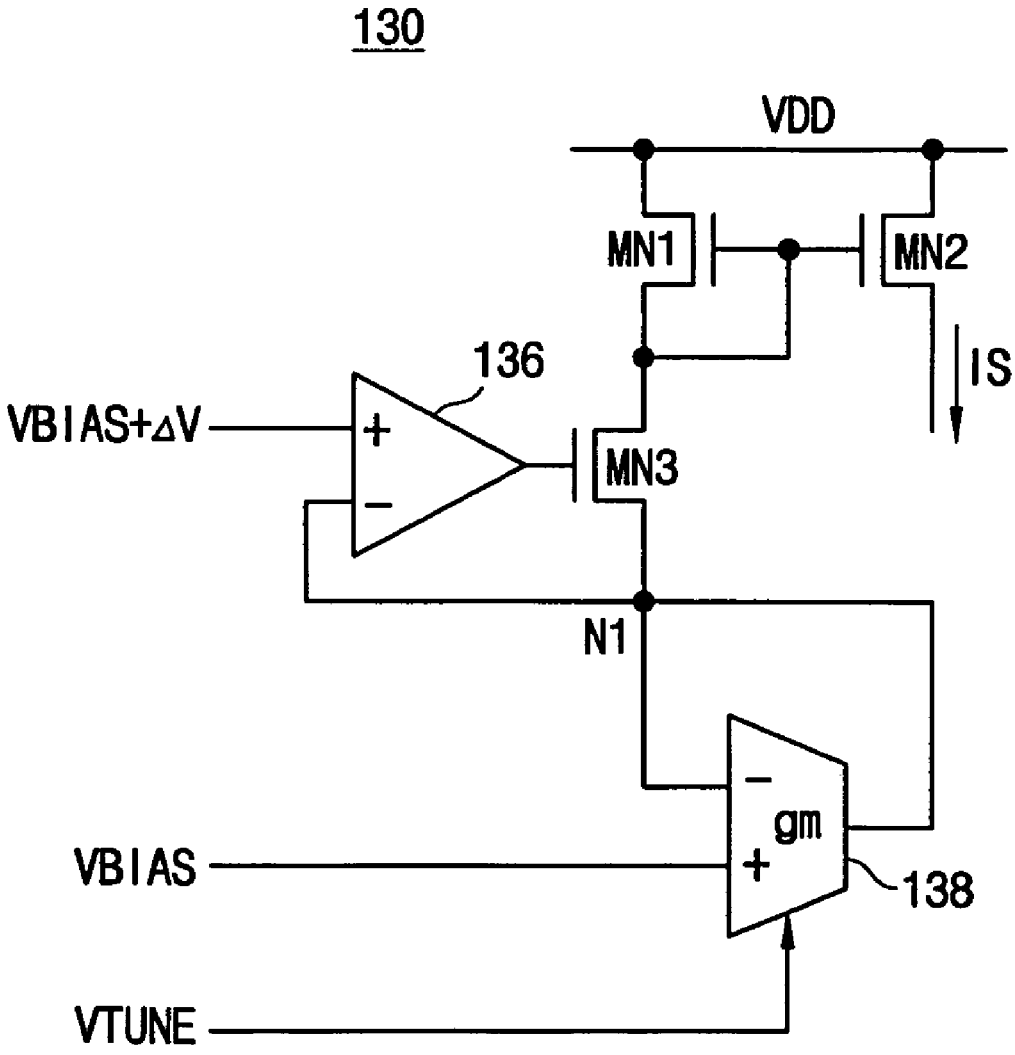
FIG. 10 is a circuit diagram showing another exemplary voltage-to-current converting circuit of the current reference circuit shown in FIG. 4.

FIG. 10 is a circuit diagram showing another exemplary voltage-to-current converting circuit of the current reference circuit shown in FIG. 4. In FIG. 10, the voltage-to-current converting circuit is configured to have a single-ended transconductance circuit.

Referring to FIG. 10, a voltage-to-current converting circuit 130 includes an operational amplifier 136, a transconductance circuit 138, a first NMOS transistor MN1, a second NMOS transistor MN2 and a third NMOS transistor MN3.

The operational amplifier 136 amplifies a voltage difference between a bias voltage VBIAS+ΔV and a node voltage at the first node N1 to output the amplified voltage difference. The transconductance circuit 138 has a noninverting input terminal to which a bias voltage VBIAS is applied and an inverting input terminal tied together with an output terminal to the first node N1. The third NMOS transistor MN3 has a gate receiving an output signal from the operational amplifier 136 and a source coupled to the first node N1. The first NMOS transistor MN1 has a gate, a drain coupled to a power voltage VDD and a source coupled to a drain of the third NMOS transistor MN3 and coupled to the gate thereof. The second NMOS transistor MN2 has a drain coupled to the power voltage VDD and a gate coupled to the gate of the first NMOS transistor MN1. The source current IS is outputted from the source of the second NMOS transistor MN2.

Hereinafter, operation of the voltage-to-current converting circuit shown in FIG. 10 will be described in detail.

When the bias voltage VBIAS+ΔV from the voltage buffer 120 shown in FIGS. 4 and 5 is applied to the noninverting input terminal of the operational amplifier 136, the bias voltage VBIAS is applied to the noninverting input terminal of the transconductance circuit 138. In addition, the voltage of VC+ΔV is applied to the first node N1 by the characteristics of the operational amplifier, and the voltage of VC+ΔV is applied to the inverting input terminal of the transconductance circuit 138. Thus, a voltage of ΔV is applied between the noninverting input terminal and the inverting input terminal of the transconductance circuit 138.

The transconductance $g_m$ of the transconductance circuit 138 is varied in response to the tuning voltage VTUNE. Thus, although the temperature and process conditions are varied, the transconductance $g_m$ of the transconductance circuit 138 is uniformly maintained. When the voltage of ΔV applied between the noninverting input terminal and the inverting input terminal of the transconductance circuit 138 and the transconductance $g_m$ are uniformly maintained, the source current IS may be uniformly maintained even though the temperature and process variations occur.

Figure 11:
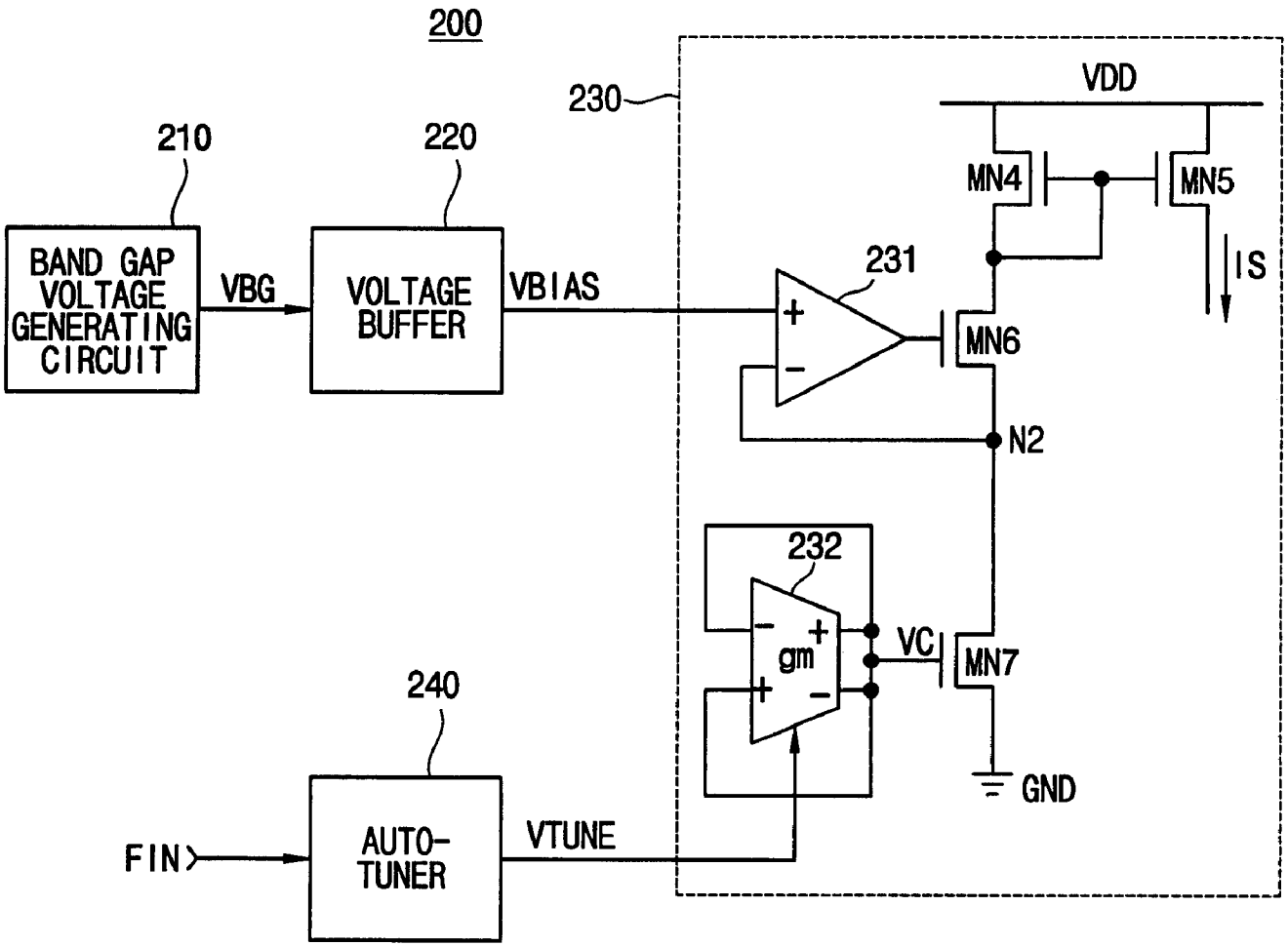
FIG. 11 is a circuit diagram showing a current reference circuit according to another exemplary embodiment of the present invention.

FIG. 11 is a circuit diagram showing a current reference circuit according to another exemplary embodiment of the present invention. In the current reference circuit 200 shown in FIG. 11, in contrast to the circuit configuration of FIG. 4, a voltage-to-current converting circuit 230 uses one bias voltage VBIAS and uses an NMOS transistor operated in a triode region as a resistor element.

Referring to FIG. 11, the current reference circuit 200 includes a band gap voltage generating circuit 210, a voltage buffer 220, a voltage-to-current converting circuit 230 and an auto-tuner 240.

The band gap voltage generating circuit 210 generates a band gap reference voltage VBG that is stable against temperature variation. The band gap reference voltage VBG is applied to the voltage buffer 220, and the voltage buffer 220 generates a bias voltage VBIAS that is stable against the temperature variation. The bias voltage VBIAS is applied to the voltage-to-current converting circuit 230, so that the voltage-to-current converting circuit 230 may vary a transconductance $g_m$ of a transconductance circuit in response to a tuning voltage VTUNE to generate a source current IS that is stable against temperature and process variations. The auto-tuner 240 has a phase-locked loop circuit configuration. The auto-tuner 240 receives an input clock signal FIN, and generates the tuning voltage VTUNE to uniformly maintain the transconductance $g_m$.

The voltage-to-current converting circuit 230 includes an operational amplifier 231, a transconductance circuit 232, NMOS transistors MN4, MN5, MN6 and MN7.

The operational amplifier 231 amplifies a voltage difference between the bias voltage VBIAS and a node voltage at a node N2 to output the amplified voltage difference. The transconductance circuit 232 has a pair of differential outputs VOUT+ and VOUT−. Two output terminals of the transconductance circuit 232 are electrically shorted to each other, and two input terminals of the transconductance circuit 232 are shorted to the two output terminals as in Nauta's transconductance circuit shown in FIGS. 3 and 6. A common mode voltage VC is outputted from the short-circuited two output terminals of the transconductance circuit 232. The transconductance circuit 232 varies the transconductance $g_m$ in response to the tuning voltage VTUNE.

The common mode voltage VC is applied to a gate of the NMOS transistor MN7 whose source is coupled to ground and whose drain is coupled to the node N2. The NMOS transistor MN6 has a gate coupled to the output of the operational amplifier 231 and a source coupled to the node N2. The NMOS transistor MN4 has a gate, a drain coupled to a power supply voltage VDD and a source coupled to a drain of the NMOS transistor MN6. The gate and source of the NMOS transistor MN4 are tied together. The NMOS transistor MN5 has a drain coupled to the power voltage VDD and a gate coupled to the gate of the NMOS transistor MN4. The source current IS is outputted from the source of the NMOS transistor MN5.

Hereinafter, operation of the voltage-to-current converting circuit 230 will be described in detail.

The bias voltage VBIAS is applied to a noninverting input terminal of the operational amplifier 231, so that the bias voltage VBIAS is applied to the node N2. The transconductance circuit 232 generates a common mode voltage VC, and varies the transconductance $g_m$ in response to the tuning voltage VTUNE.

The current reference circuit 200 uses the NMOS transistors operated in the triode region as resistor elements. In Nauta's transconductance circuit, when the transconductances gmp and gmn of a PMOS transistor and a NMOS transistor respectively constituting an inverter are substantially equal to each other, the equation 1 may be expressed by the following equation 2.

$$gm \approx 2\beta n(Vc - Vtn) \quad \text{(Equation 2)}$$

When the NMOS transistor is operated in a linear region, a drain current may be given by the following equation 3.

$$Ids = \beta n((Vgs - Vtn) - Vds^2/2) \times Vds \quad \text{(Equation 3)}$$

where Ids, Vgs, Vds and Vtn indicate a drain-source current, a gate-source voltage, a drain-source voltage and a threshold voltage of the NMOS transistor, respectively. Since Vds has an extremely small value when the NMOS transistor is operated in the triode region, the equation 3 may be expressed by the following equation 4.

$$Ids \approx \beta n(Vgs - Vtn) \times Vds \quad \text{(Equation 4)}$$

Thus, the resistance of the NMOS transistor may be expressed by the following equation 5.

$$R \approx 1/\beta n(Vgs - Vtn) \approx 1/\beta n(Vc - Vtn) \approx 2/gm \quad \text{(Equation 5)}$$

where Vc indicates the common mode voltage.

In accordance with the equation 2 and equation 5, when the transconductance $g_m$ is uniformly maintained by the tuning voltage VTUNE generated from the auto-tuner 240, the resistance of the NMOS transistor also may be uniformly maintained. In order to approximate the equation 5, the NMOS transistor may operate in a deep triode region where Vds has a small value. Furthermore, when the NMOS functioning as the resistor is designed to have a length over a few micrometers, an error of process may be reduced.

Table 1 represents a simulation result for variations of the source current in accordance with the temperature and process variations when the current reference circuit of FIG. 11 is designed by a CMOS process of 0.18 micrometers. In a process corner of Table 1, 'T', 'F' and 'S' indicate 'Typical', 'Fast' and 'Slow', respectively, and a process corner of NMOS transistor is represented together with a process corner of PMOS transistor.

TABLE 1

| Corner | Temp [C.] | Vtune [V] | IS [μA] | Deviation of IS |
|---|---|---|---|---|
| TT | 27 | 2.14 | 1.2 | |
| TT | −40 | 2.08 | 1.21 | 0.8% |
| TT | 100 | 2.21 | 1.17 | −2.5% |
| FF | −40 | 1.89 | 1.28 | 6.7% |
| SS | 100 | 2.40 | 1.13 | −5.8% |
| SF | −40 | 2.02 | 1.17 | −2.5% |
| FS | 100 | 2.23 | 1.19 | −0.8% |

Referring to Table 1, it can be seen from the simulation result that, regardless of the extent of the temperature and process variations, the deviation of accuracy of the source current IS is within ±10% in the worst case.

According to the current reference circuit, the transconductance circuit may automatically adjust the transconductance $g_m$, so that the current reference circuit may supply the source current that is stable against the temperature and process variations.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A current reference circuit comprising:

a band gap voltage generating circuit configured to generate a band gap reference voltage that is stable against a temperature variation;

a voltage buffer configured to generate a first bias voltage and a second bias voltage in response to the band gap reference voltage, the first and second bias voltages being stable against the temperature variation;

a voltage-to-current converting circuit configured to generate a source current that is stable against temperature and process variations using a transconductance circuit responding to a tuning voltage, in response to the first and second bias voltages; and an auto-tuner having a phase-locked loop circuit, the auto-tuner receiving an input clock signal and generating the tuning voltage to maintain a transconductance value of the transconductance circuit.

2. The current reference circuit of claim 1, wherein the voltage buffer comprises:

an operational amplifier having a first input terminal receiving the band gap reference voltage, a second input terminal receiving a node voltage of a first node and an output terminal, the operational amplifier amplifying a difference between the band gap reference voltage and the first node voltage;

a feedback resistor coupled between the output terminal of the operational amplifier and the second input terminal of the operational amplifier; and a quantity n resistors coupled in series between the first node and a ground.

3. The current reference circuit of claim 2, wherein the first bias voltage is outputted from an i-th resistor among the n resistors numbered from the first node, and the second bias voltage is outputted from an i−1-th resistor among the n resistors numbered from the first node.

4. The current reference circuit of claim 2, wherein the n resistors have equal resistance values.

5. The current reference circuit of claim 1, wherein the voltage-to-current converting circuit comprises:

a common mode voltage generator configured to maintain the transconductance value in response to the tuning voltage, and configured to generate a common mode voltage;

a differential voltage generator configured to generate a pair of differential voltages, in response to the first bias voltage, the second bias voltage and the common mode voltage, an average voltage level of the differential voltage pair being substantially equal to the common mode voltage; and a voltage-to-current converter configured to generate the source current that is stable against temperature and process variations by the transconductance circuit responding to the tuning voltage in response to the differential voltage pair.

6. The current reference circuit of claim 5, wherein the common mode voltage generator includes a first transconductance circuit having two output terminals electrically shorted to each other and two input terminals commonly coupled to the output terminals, the first transconductance circuit generating the common mode voltage.

7. The current reference circuit of claim 5, wherein the differential voltage generator comprises:

a first output terminal;

a second output terminal;

a first differential input part having a first input terminal connected to the second output terminal and a second input terminal to which the first bias voltage is applied; and a second differential input part having a first input terminal coupled to the first output terminal and a second input terminal to which the second bias voltage is applied.

8. The current reference circuit of claim 5, wherein the voltage-to-current converter comprises:

an operational amplifier configured to amplify a difference between a first output voltage of the differential voltage generator and the node voltage of the first node;

a second transconductance circuit having a first input terminal, a second output terminal coupled to the first input terminal, a second input terminal commonly coupled to the first node with a first output terminal, the second transconductance circuit receiving a second output voltage from the differential voltage generator through the first input terminal to vary the transconductance value in response to the tuning voltage;

a first NMOS transistor whose gate is coupled to the output of the operational amplifier to receive the amplified difference signal and whose source is coupled to the first node; and a current mirror circuit, coupled to a drain of the first NMOS transistor, configured to supply a first current to the first NMOS transistor, and configured to generate the source current corresponding to the first current.

9. The current reference circuit of claim 8, wherein the current mirror circuit comprises:

a second NMOS transistor having a gate, a drain coupled to a power voltage and a source coupled to the drain of the first NMOS transistor, the gate being coupled to the source; and a third NMOS transistor having a drain coupled to the power voltage, a gate coupled to the gate of the second NMOS transistor and a source from which the source current is outputted.

10. The current reference circuit of claim 1, wherein the auto-tuner comprises:

a phase-frequency detector configured to detect a phase difference and a frequency difference between an input clock signal and a feedback signal;

a charge pump configured to generate a signal responding to an output signal from the phase-frequency detector;

a loop filter configured to remove a high frequency component in an output signal from the charge pump and configured to integrate the output signal from which the high frequency component is removed to generate the tuning voltage; and a voltage controlled oscillator configured to generate the feedback signal having a frequency corresponding to a level of the tuning voltage.

11. The current reference circuit of claim 10, wherein the auto-tuner further comprises a divider configured to divide the feedback signal outputted from the voltage controlled oscillator and configured to feed-back the divided feedback signal to the phase-frequency detector.

12. The current reference circuit of claim 10, wherein the voltage controlled oscillator comprises:

a first VCO transconductance circuit configured to have a first input terminal, a second input terminal, a first output terminal and a second output terminal, and configured to have a transconductance value that is maintained as substantially a constant value in response to the tuning voltage;

a second VCO transconductance circuit configured to have a first input terminal coupled to the second output terminal of the first VCO transconductance circuit, a second input terminal coupled to the first output terminal of the first VCO transconductance circuit, a first output terminal coupled to the first input terminal of the first VCO transconductance circuit and a second output terminal connected to the second input terminal of the first VCO transconductance circuit, and configured to have a transconductance value uniformly maintained in response to the tuning voltage;

a first capacitor coupled between the second output terminal of the first VCO transconductance circuit and the second input terminal of the second VCO transconductance circuit;

a second capacitor coupled between the first input terminal of the first VCO transconductance circuit and the second output terminal of the second VCO transconductance circuit;

a first resistor coupled between the first input terminal of the first VCO transconductance circuit and the second output terminal of the second VCO transconductance circuit; and a second resistor coupled between the first input terminal of the first VCO transconductance circuit and the second output terminal of the second VCO transconductance circuit, the second resistor having an opposite polarity to the first resistor.

13. The current reference circuit of claim 1, wherein the voltage-to-current converting circuit comprises:

an operational amplifier configured to amplify a difference between the second bias voltage and a node voltage of a first node to output a difference signal;

a transconductance circuit having a first input terminal, a second output terminal coupled to the first input terminal, a second input terminal commonly coupled to the first node with a first output terminal, the transconductance circuit receiving the first bias voltage through the first input terminal to vary the transconductance value in response to the tuning voltage;

a first NMOS transistor having a gate receiving the difference signal from the operational amplifier and a source coupled to the first node; and a current mirror circuit coupled to a drain of the first NMOS transistor, configured to supply a first current to the first NMOS transistor and configured to generate the source current corresponding to the first current.

14. The current reference circuit of claim 13, wherein the current mirror circuit comprises:

a second NMOS transistor having a gate, a drain coupled to a power voltage and a source coupled to the drain of the first NMOS transistor, the gate being coupled to the source; and a third NMOS transistor having a drain coupled to the power voltage, a gate coupled to the gate of the second NMOS transistor and a source from which the source current is outputted.

15. A current reference circuit comprising:

a band gap voltage generating circuit configured to generate a band gap reference voltage that is stable against a temperature variation;

a voltage buffer configured to generate a bias voltage that is stable against the temperature variation in response to the band gap reference voltage;

a voltage-to-current converting circuit configured to generate a source current in response to the bias voltage, the source current being stable against temperature and process variations in response to a tuning voltage; and an auto-tuner configured to generate a tuning voltage in response to an input clock signal to maintain a transconductance ($g_m$) value of a transconductance circuit.

16. The current reference circuit of claim 15, wherein the voltage-to-current converting circuit comprises:

an operational amplifier configured to amplify a difference between the bias voltage and a node voltage of a first node to output the amplified signal;

a first NMOS transistor having a gate coupled to an output of the operational amplifier to receive the amplified signal and a source coupled to the first node;

a current mirror circuit coupled to a drain of the first NMOS transistor, configured to apply a first current to the first NMOS transistor, and configured to generate the source current corresponding to the first current;

a transconductance circuit configured to have two output terminals electrically shorted to each other and two input terminals commonly coupled to the two output terminals, and configured to generate a common mode voltage; and a second NMOS transistor having a gate receiving the common mode voltage, a drain coupled to the first node and a source coupled to ground.

17. The current reference circuit of claim 16, wherein the current mirror circuit comprises:

a third NMOS transistor having a gate, a drain coupled to a power voltage and a source coupled to the drain of the first NMOS transistor, the gate being coupled to the source; and a fourth NMOS transistor having a drain coupled to the power voltage, a gate coupled to the gate of the third NMOS transistor and a source from which the source current is outputted.

18. A voltage-to-current converting circuit comprising:

a common mode voltage generator configured to maintain a transconductance value in response to a tuning voltage to generate a common mode voltage;

a differential voltage generator configured to generate a pair of differential voltages in response to a first bias voltage, a second bias voltage greater than the first bias voltage and the common mode voltage, an average voltage level of the differential voltage pair being substantially equal to the common mode voltage; and a voltage-to-current converter configured to generate a source current in response to the differential voltage pair, the source current being stable against temperature and process variations in response to the tuning voltage.

19. The voltage-to-current converting circuit of claim 18, wherein the common mode voltage converter comprises a first transconductance circuit having two output terminals electrically shorted to each other and two input terminals commonly coupled to the two output terminals, the first transconductance circuit generating the common mode voltage.

20. The voltage-to-current converting circuit of claim 18, wherein the differential voltage generator comprises:

a first output terminal;

a second output terminal;

a first differential input part having a first input terminal coupled to the second output terminal and a second input terminal receiving the first bias voltage; and a second differential input part having a first input terminal coupled to the first output terminal and a second input terminal receiving the second bias voltage.

21. The voltage-to-current converting circuit of claim 18, wherein the voltage-to-current converter comprises:

an operational amplifier configured to amplify a difference between a first output voltage of the differential voltage generator an d a node voltage of a first node to generate the amplified signal;

a second transconductance circuit having a first input terminal, a second output terminal coupled to the first input terminal, a second input terminal and a first output terminal commonly coupled to the first node with the second input terminal, the second transconductance circuit receiving a second output voltage from the differential voltage generator through the first input terminal and varying a transconductance value in response to the tuning voltage;

a first NMOS transistor having a gate coupled to an output of the operational amplifier to receive the amplified signal and a source coupled to the first node; and a current mirror circuit, coupled to a drain of the first NMOS transistor, configured to apply a first current to the first NMOS transistor, and configured to generate the source current in response to the first current.

22. The voltage-to-current converting circuit of claim 21, wherein the current mirror circuit comprises:

a second NMOS transistor having a gate, a drain coupled to a power voltage and a source coupled to the drain of the first NMOS transistor, the gate being coupled to the source; and a third NMOS transistor having a drain coupled to the power voltage, a gate coupled to the gate of the second NMOS transistor and a source from which the source current is outputted.

* * * * *